US009679714B2

(12) United States Patent
Chen

(10) Patent No.: US 9,679,714 B2
(45) Date of Patent: Jun. 13, 2017

(54) MULTI-USE SWITCH FOR ELECTRONIC DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Zhou Chen, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 19 days.

(21) Appl. No.: 14/819,607

(22) Filed: Aug. 6, 2015

(65) Prior Publication Data

US 2016/0118202 A1 Apr. 28, 2016

(30) Foreign Application Priority Data

Oct. 28, 2014 (CN) ..... 2014 1 0585884

(51) Int. Cl.

| | |
|---|---|
| ***H01H 13/00*** | (2006.01) |
| ***H01H 13/14*** | (2006.01) |
| ***H01H 13/64*** | (2006.01) |
| *H01H 1/36* | (2006.01) |

(52) U.S. Cl.

CPC ..... *H01H 13/14* (2013.01); *H01H 13/64* (2013.01); *H01H 1/36* (2013.01)

(58) Field of Classification Search

CPC ..... H01H 13/02; H01H 13/12; H01H 13/64; H01H 15/06; H01H 41/00; H01H 41/14

USPC ..... 200/16 R, 16 B, 238, 275, 279, 345

See application file for complete search history.

(56) References Cited

U.S. PATENT DOCUMENTS 7,385,530 B2 * 6/2008 Griffin ..... H01H 13/84 341/22

8,314,721 B2 * 11/2012 Xu ..... H01H 13/64 200/314

* cited by examiner

*Primary Examiner* — Vanessa Girardi

(74) *Attorney, Agent, or Firm* — Steven Reiss

(57) ABSTRACT

A multi-use switch for an electronic device includes a pressing piece configured to be pressed by an external force, a number of conducting elements located on the pressing piece and electrically coupled to a number of functional circuits of the electronic device one-to-one, and at least one coupling element configured to be electrically coupled to the conducting elements. The multi-use switch is partially received inside a housing. The coupling element is fixed to the housing. The pressing piece moves along an axis to move the conducting elements relative to the coupling element. The coupling element completes an electric circuit of one of the functional circuits when the corresponding conducting element is moved to electrically couple to the at least one coupling element. One electric circuit of the functional circuits is able to be completed at any one time.

17 Claims, 15 Drawing Sheets

MULTI-USE SWITCH FOR ELECTRONIC DEVICE

FIELD

The subject matter herein generally relates to electronic devices, and more particularly to a multi-use switch of an electronic device.

BACKGROUND

An electronic device may have a plurality of switches. Each switch may be turned on and off by a corresponding button. If the switches can be combined into one, it will save space of the electronic device occupied by the switches and facilitate a user's operation of the electronic device.

BRIEF DESCRIPTION OF THE DRAWINGS

Implementations of the present technology will now be described, by way of example only, with reference to the attached figures.

DETAILED DESCRIPTION

Figure 1:
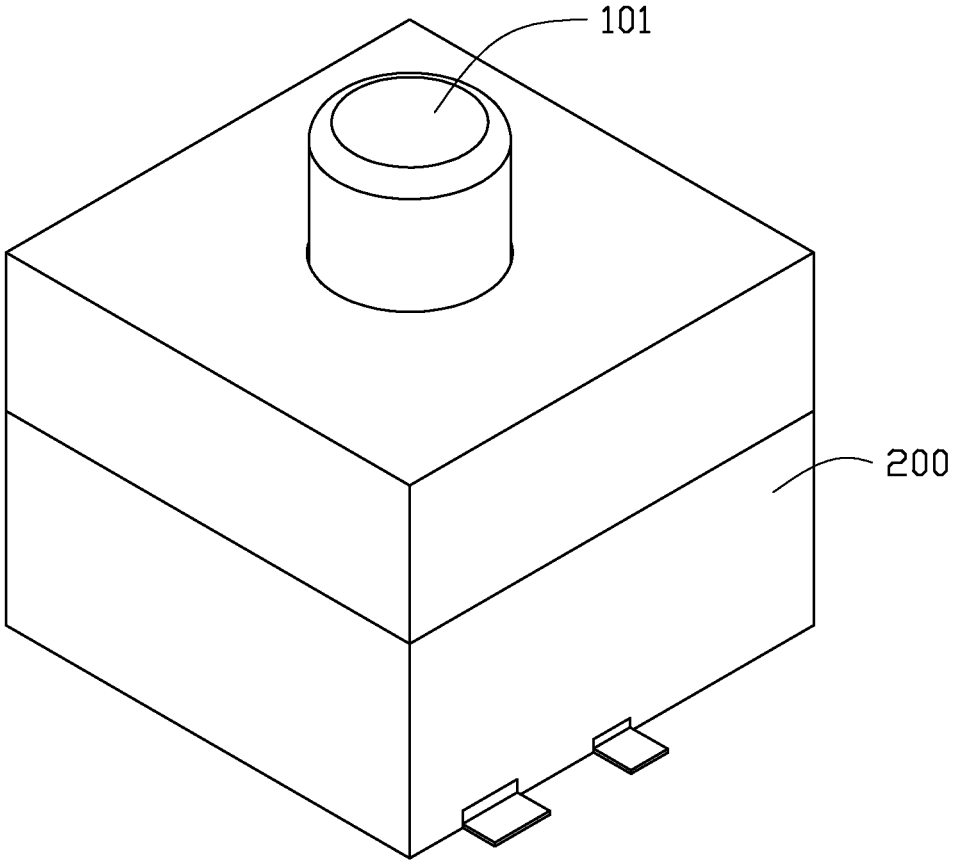
FIG. 1 is an assembled, isometric view of a multi-use switch of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates an embodiment of a multi-use switch 101 for an electronic device (not shown). The multi-use switch 101 can be partially received in a housing 200. The housing 200 can be a part of the electronic device, or be assembled with the multi-use switch 101 in advance before the multi-use switch 101 is mounted to the electronic device.

Figure 2:
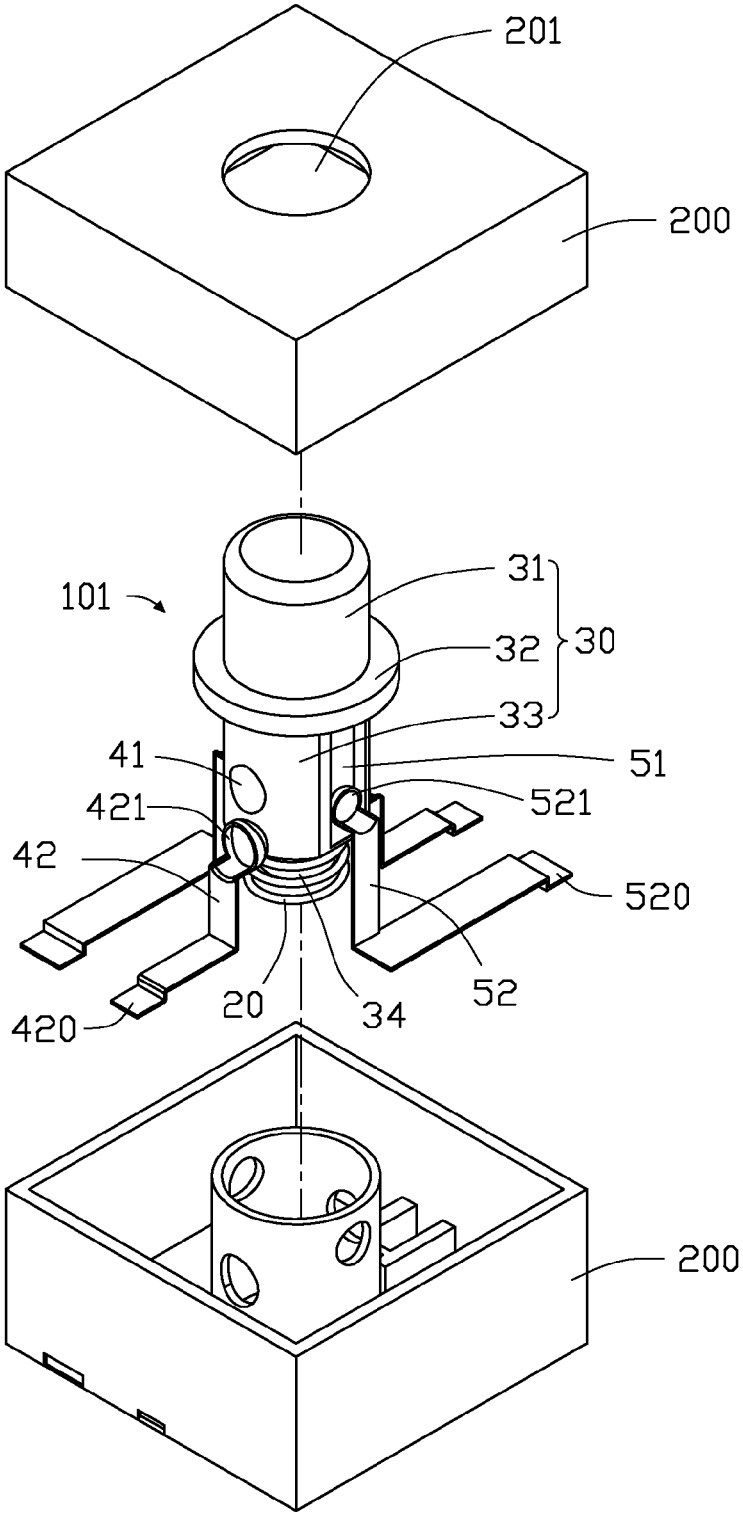
FIG. 2 is an exploded, isometric view of a first embodiment of the multi-use switch of FIG. 1.

Referring to FIG. 2, the multi-use switch 101 can include a pressing piece 30. The pressing piece 30 can include a first columnar portion 31, a limiting flange 32, and a second columnar portion 33. The first columnar portion 31 can extend out of a hole 201 defined in the housing 200. The limiting flange 32 can resist against an inner surface of the housing 200 surrounding the hole 201 to prevent the second columnar portion 33 from extending out of the hole 201. A mounting post 34 can protrude from the second columnar portion 33, and an elastic member 20 can be sleeved on the mounting post 34. The elastic member 20 can be coupled to the housing 200. In at least one embodiment, the elastic member 20 is a compression spring. The elastic member 20 can be compressed by an external force pushing the first columnar portion 31 to move along an axis of the pressing piece 30. The elastic member 20 can restore to move the pressing piece 30 back along the axis when the external force is removed.

The multi-use switch 101 can further include at least one conducting element 41, and at least one coupling element 42. Each conducting element 41 can be electrically coupled to a corresponding functional circuit 60 (shown in FIG. 3) one-to-one. In a first embodiment, there are three coupling elements 42, and each coupling element 42 corresponds to one conducting element 41. Each conducting element 41 can be received in a groove (not labeled) defined in a circumferential periphery of the second columnar portion 33. Each coupling element 42 can include a fixing portion 420 and a coupling head 421. The fixing portion 420 can be fixed to the housing 200, thereby fixing the coupling element 42 in place. The coupling head 421 can be aligned with the corresponding conducting element 41 along the axis of the pressing piece 30. The coupling head 421 can be slidably coupled to the second columnar portion 33, so that the coupling head 421 of one coupling element 42 can be received in the groove of the corresponding conducting element 41 when the pressing piece 30 is moved along the axis. In at least one embodiment, only one coupling head 421 is able to be received in the groove of the corresponding conducting element 41 at any one time.

Figure 3:
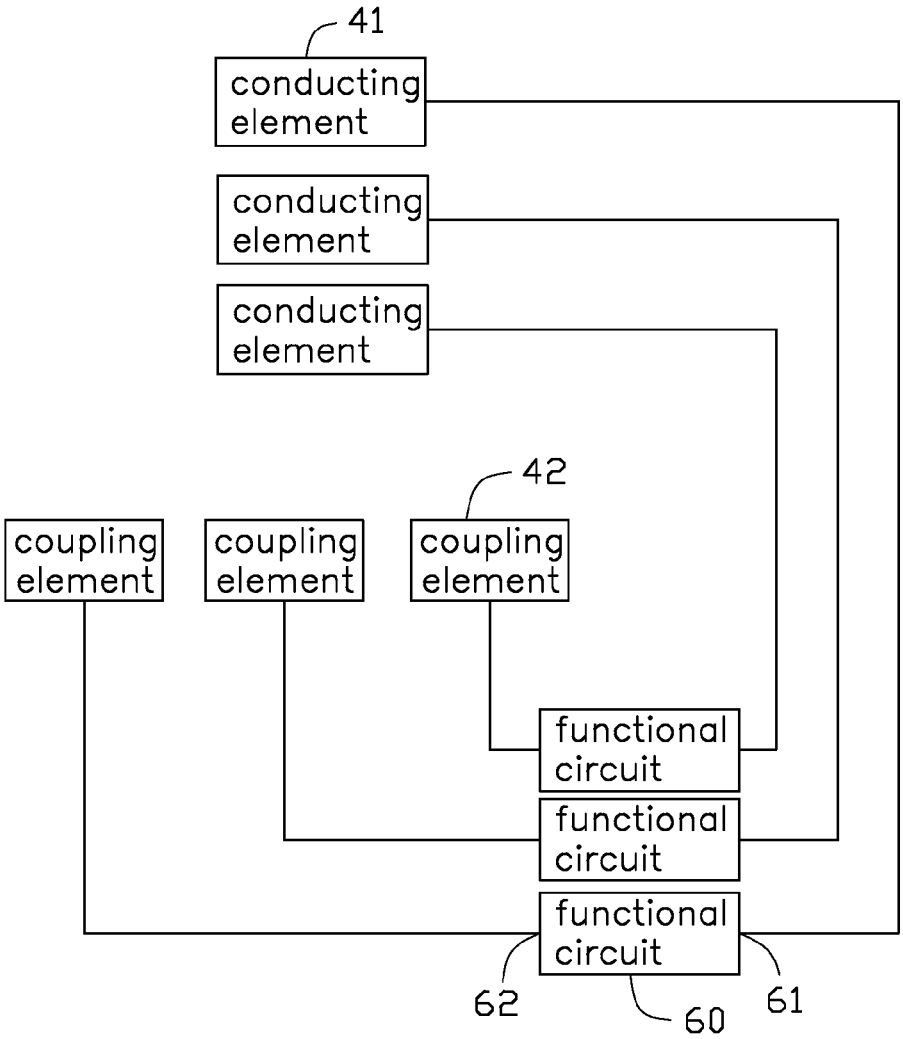
FIG. 3 is a block diagram of the first embodiment of the multi-use switch of FIG. 2.

Referring to FIG. 3, the conducting element 41 can be electrically coupled to a first terminal 61 of the functional circuit 60, and the coupling element 42 can be electrically coupled to a second terminal 62 of the functional circuit 60. When one of the coupling elements 42 is electrically coupled to the corresponding conducting element 41, the coupling element 42 and the corresponding conducting element 41 cooperatively complete an electric circuit of the functional circuit 60. Because only one coupling element 42 is able to be electrically coupled to the corresponding conducting element 41 at any one time, only one electric circuit of the functional circuits 60 can be completed at any one time.

Figure 4:
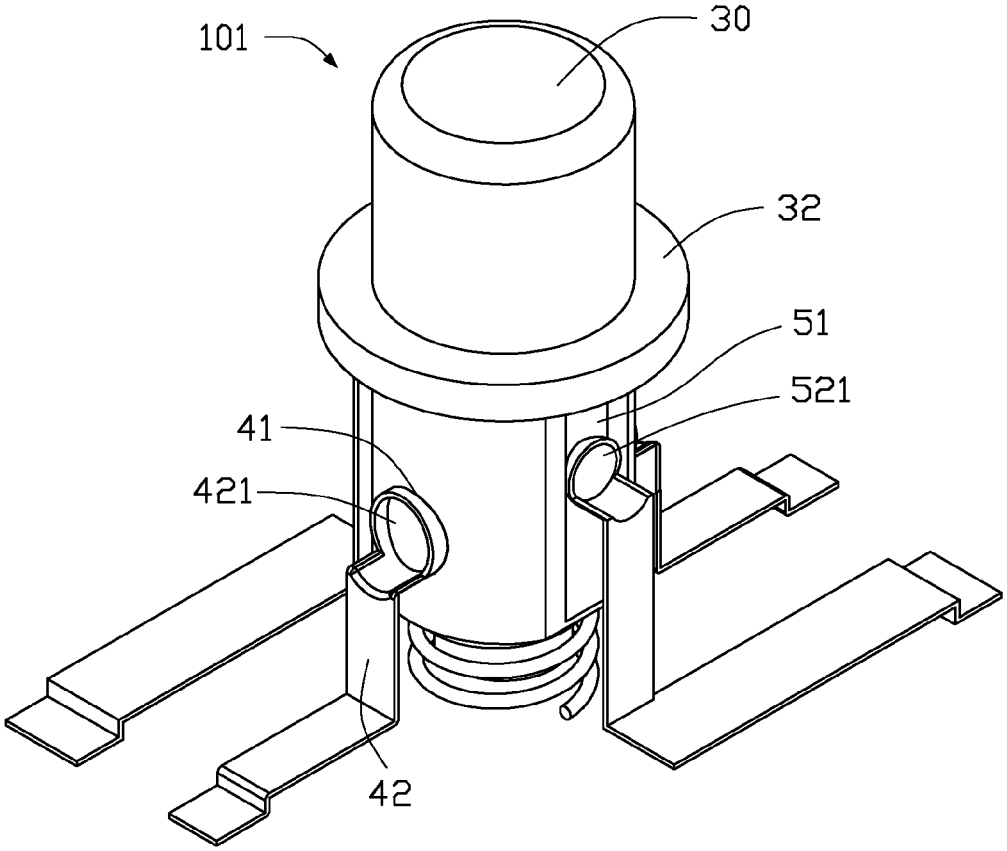
FIG. 4 is an isometric view of the first embodiment of the multi-use switch in a state of use.
Figure 5:
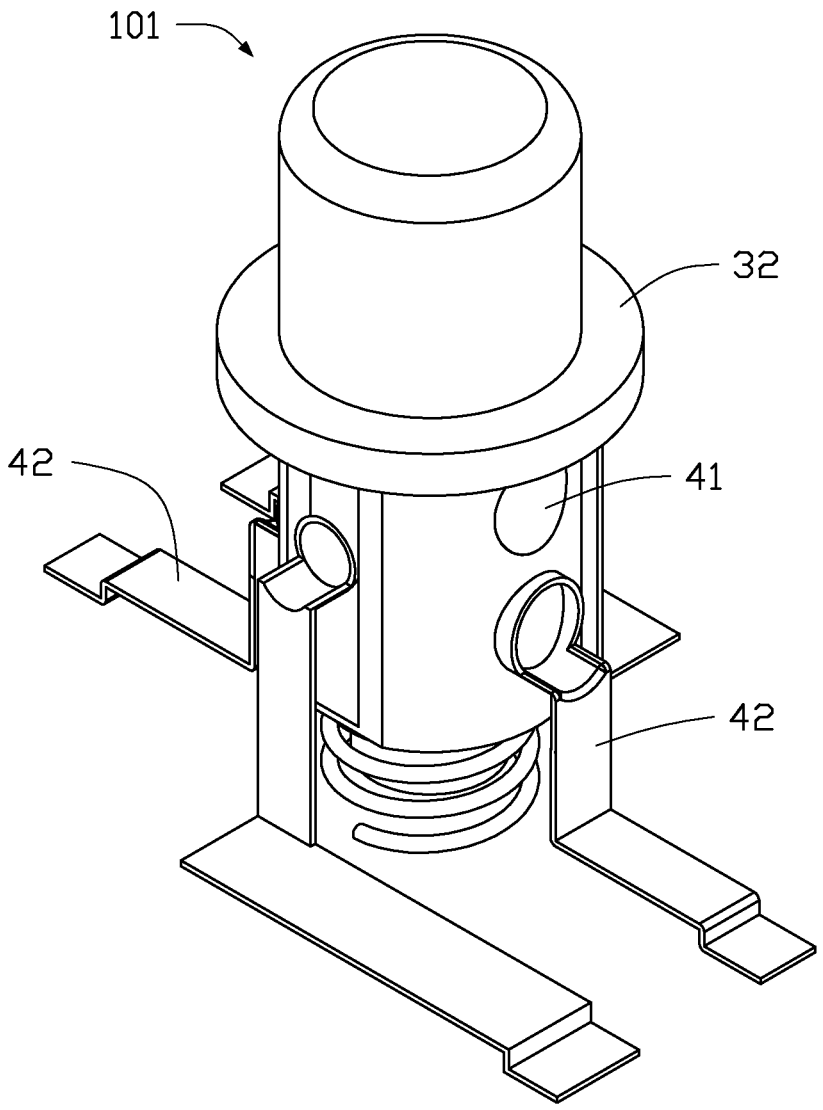
FIG. 5 is similar to FIG. 4, but viewed from another angle.

Referring to FIGS. 4 and 5, the pressing piece 30 can be pressed by the external force to move the pressing piece 30 relative to the coupling elements 42 to make one of the coupling heads 421 be received in the groove of the corresponding conducting element 41 to be electrically coupled to the conducting element 41. As illustrated in FIGS. 4 and 5, the conducting elements 41 are located at different distances away from the limiting flange 32, and the coupling heads 421 of the coupling elements 42 are located a same distance away from the limiting flange 32. Thus, only one coupling head 421 can be received in the groove of the corresponding conducting element 41. In other embodiments, the conducting elements 41 can be located at a same distance away from the limiting flange 32, and the coupling heads 421 of the coupling elements 42 can be located at different distance away from the limiting flange 32. When the external force is removed from the pressing piece 30, the coupling head 421 can remain received in the hole of the corresponding conducting element 41.

Figure 6:
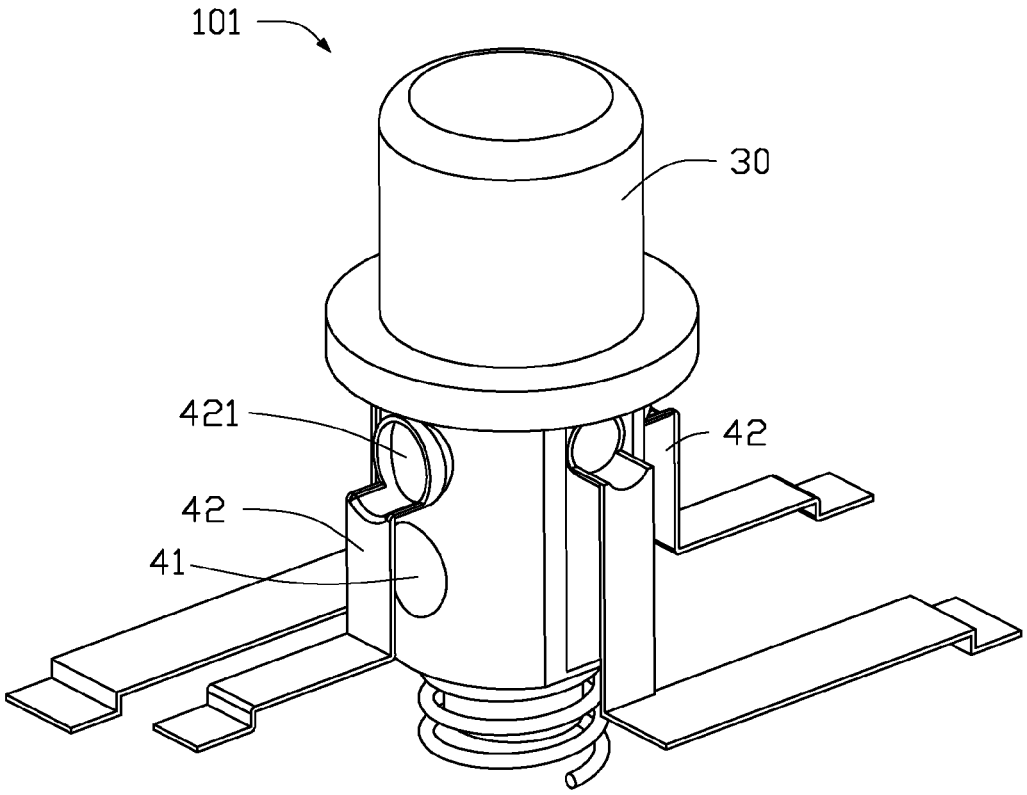
FIG. 6 is an isometric view of the first embodiment of the multi-use switch in another state of use.
Figure 7:
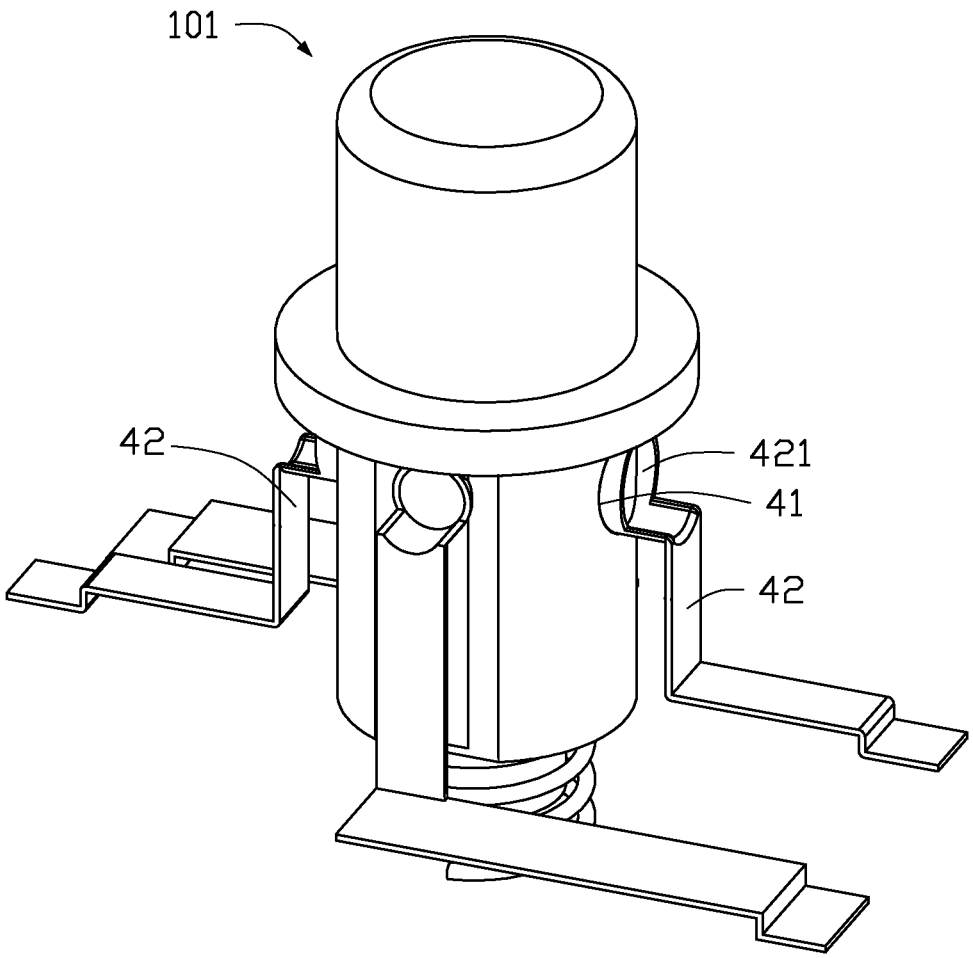
FIG. 7 is similar to FIG. 6, but viewed from another angle.

Referring to FIGS. 6 and 7, the external force can continue to press the pressing piece 30 to move the pressing piece 30 relative to the coupling elements 42, to make another coupling head 421 be received in the groove of the corresponding conducting element 41 to electrically couple to the conducting element 41.

Referring again to FIG. 2, the multi-use switch 101 can further include at least one linking element 52. The linking element 52 can include a second fixing portion 520 and a sliding head 521. The second fixing portion 520 can be fixed to the housing 200, and the sliding head 521 can be slidably received in a sliding groove 51 defined in the circumferential periphery of the second columnar portion 33 along a longitudinal direction thereof. Thus, the sliding head 521 can slide along the sliding groove 51 as the pressing piece 30 moves along the axis. The linking element 52 and the coupling element 42 can cooperatively limit the pressing piece 30 to move along the axis.

Figure 8:
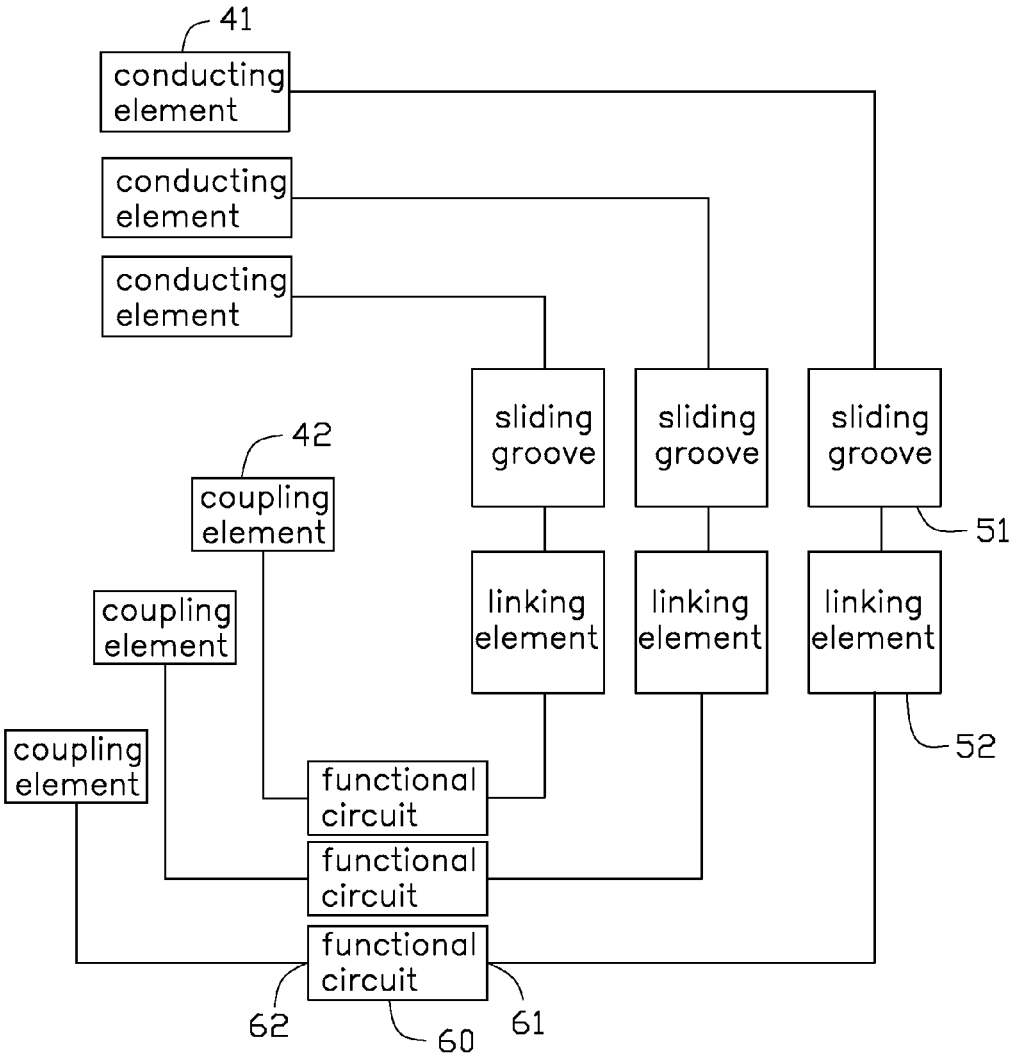
FIG. 8 is a block diagram of a second embodiment of the multi-use switch.

FIG. 8 illustrates a second embodiment of the multi-use switch 101. In the second embodiment, a portion of the second columnar portion 33 located in the sliding groove 51 can allow the linking element 52 to be electrically coupled to a corresponding functional circuit 60 by having electrically conductive material coated in the sliding groove 51. A number of the linking elements 52 can be three, and the linking elements 52 can be electrically coupled between the conducting elements 41 and the functional circuits 60 one-to-one through the electrically conductive material in the corresponding sliding groove 51. Thus, the functional circuits 60 are electrically coupled between the coupling elements 42 and the linking elements 52 one-to-one.

Figure 9:
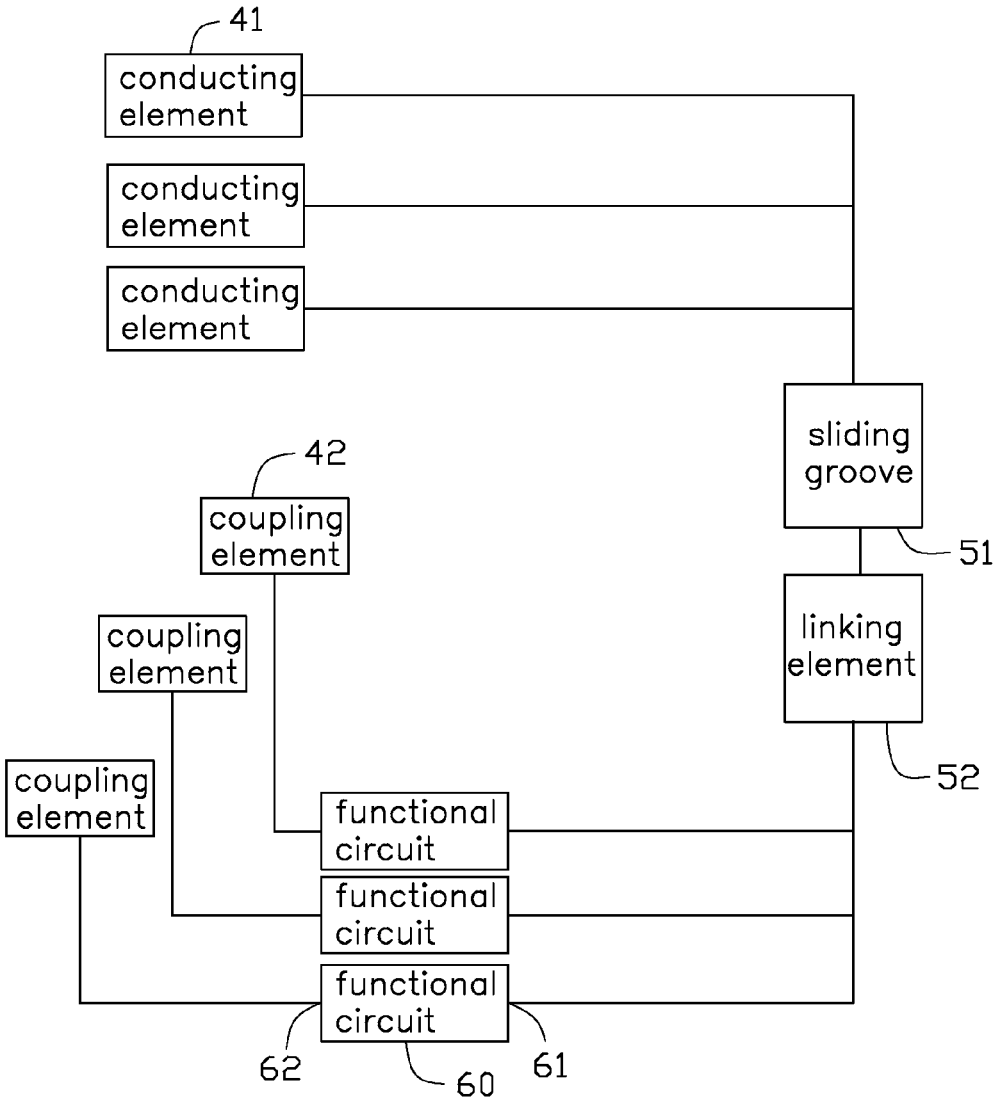
FIG. 9 is a block diagram of a third embodiment of the multi-use switch.

FIG. 9 illustrates a third embodiment of the multi-use switch 101. In the third embodiment, there is only one linking element 52. Thus, each conducting element 41 and each functional circuit 60 are electrically coupled to the linking element 52 through the sliding groove 51 which has electrically conductive material coated therein. In at least one embodiment, the linking element 52 can be electrically coupled between the conducting elements 41 and the functional circuits 60 in parallel.

Figure 10:
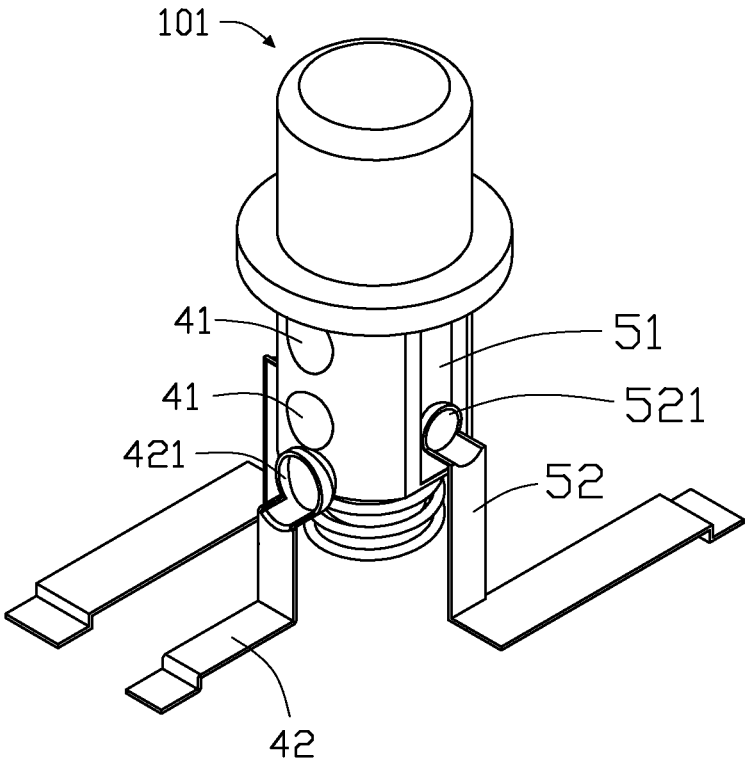
FIG. 10 is an isometric view of a fourth embodiment of the multi-use switch.

FIG. 10 illustrates a fourth embodiment of the multi-use switch 101. In the fourth embodiment, the conducting elements 41 in the corresponding grooves can be aligned along the axis of the pressing piece 30, and a number of the coupling elements 42 is one. Thus, the coupling element 42 can be electrically coupled to the conducting elements 41 in turn as the pressing piece moves along the axis.

Figure 11:
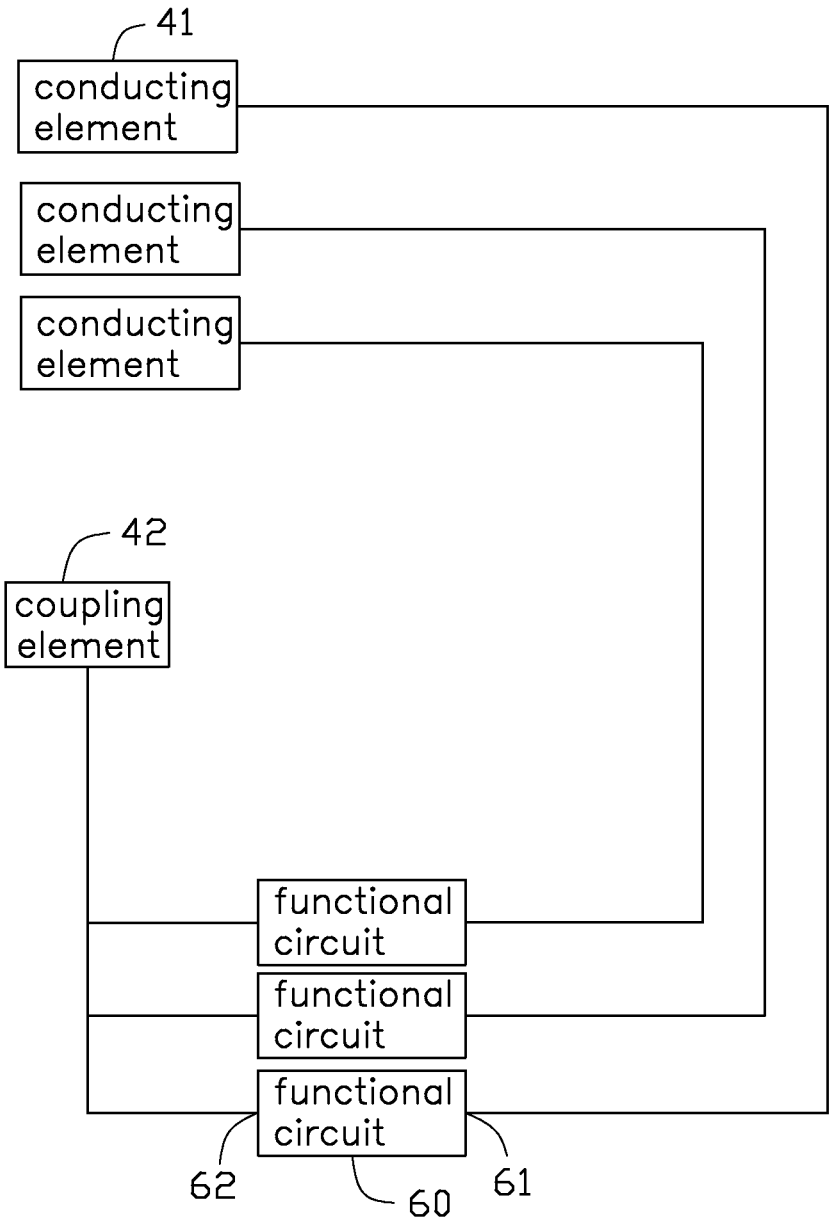
FIG. 11 is a block diagram of the fourth embodiment of the multi-use switch.

Referring to FIG. 11, the coupling element 42 can be electrically coupled to each of the functional circuits 60. In at least one embodiment, the coupling element 42 is electrically coupled to each of the functional circuits 60 in parallel.

Figure 12:
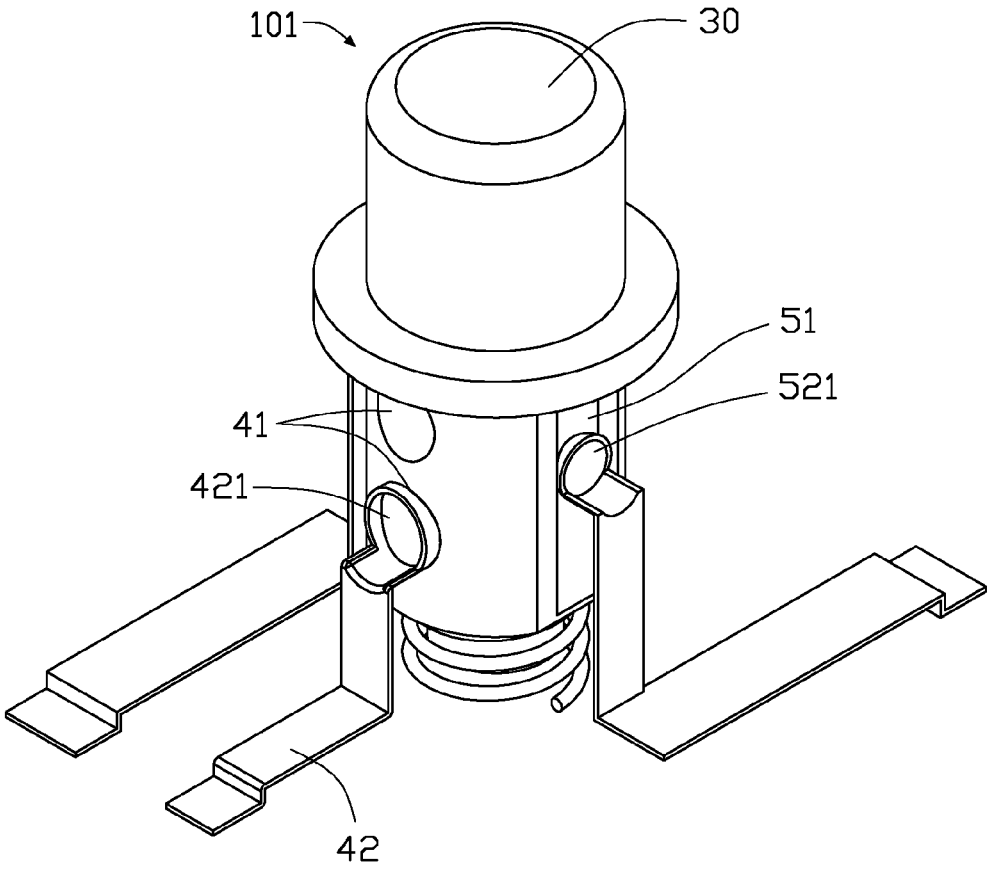
FIG. 12 is an isometric view of the fourth embodiment of the multi-use switch in a state of use.
Figure 13:
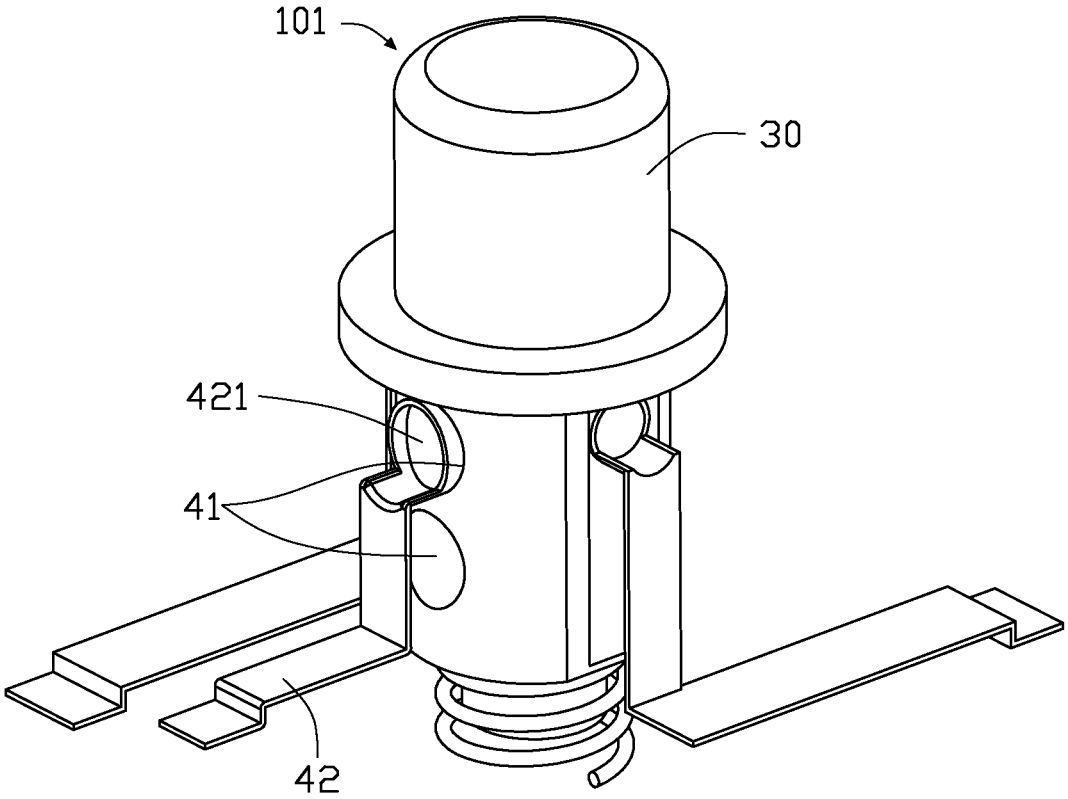
FIG. 13 is an isometric view of the fourth embodiment of the multi-use switch in another state of use.

Referring to FIGS. 12 and 13, the pressing piece 30 can be pressed to move along the axis to make the coupling element 42 be received in a first groove to be electrically coupled to the corresponding conducting element 41. When the pressing piece 30 is pressed further, the coupling element 42 can be received in a second groove to be electrically coupled to the corresponding conducting element 41.

Figure 14:
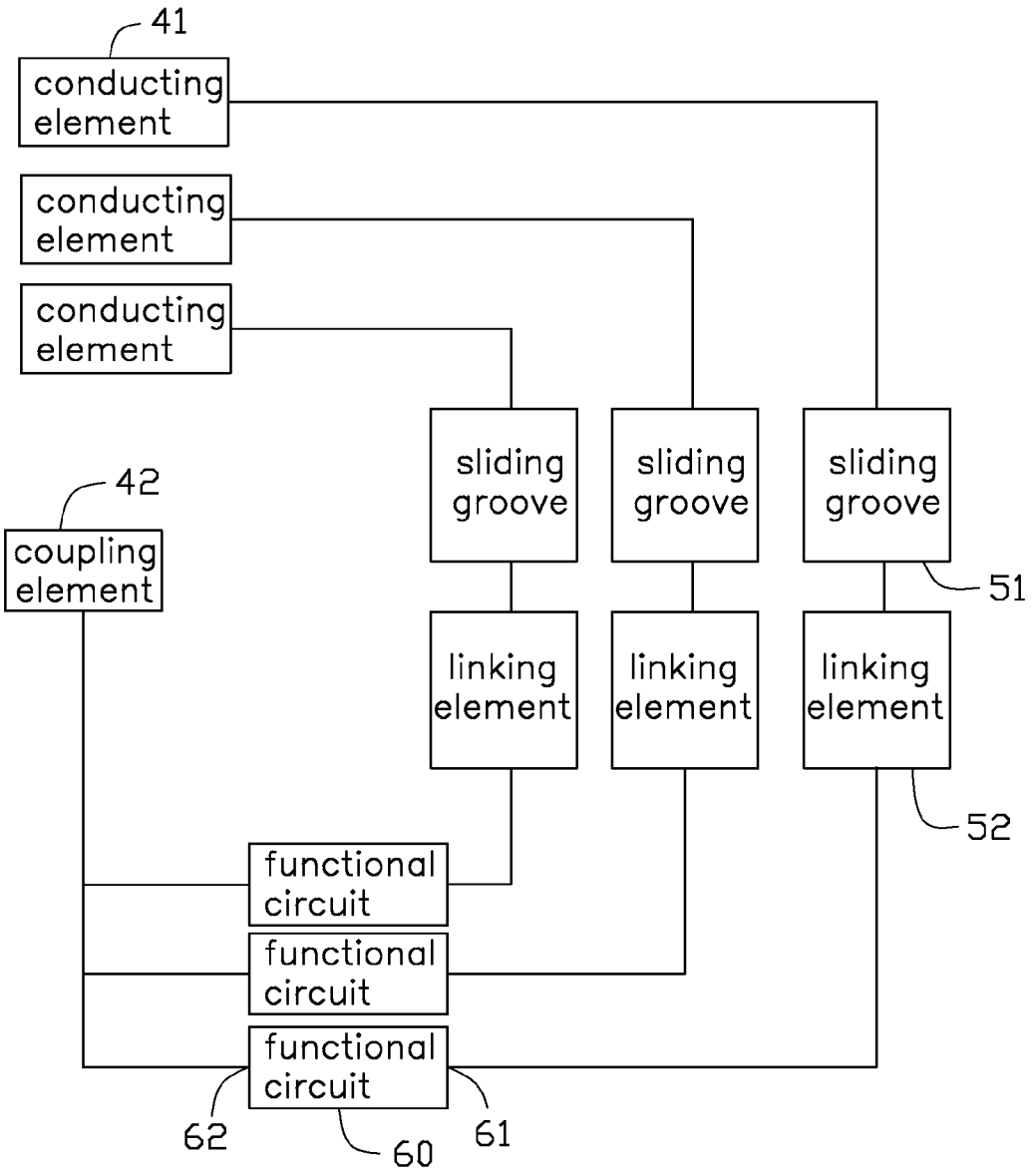
FIG. 14 is a block diagram of a fifth embodiment of the multi-use switch.

Referring to FIG. 14, in a fifth embodiment of the multi-use switch 101, the linking elements 52 can be electrically coupled between the functional circuits 60 and the conducting elements 41 one-to-one through the corresponding sliding grooves 51. A number of the coupling elements 42 is one, and the coupling element 42 can be electrically coupled to the functional circuits 60 in parallel.

Figure 15:
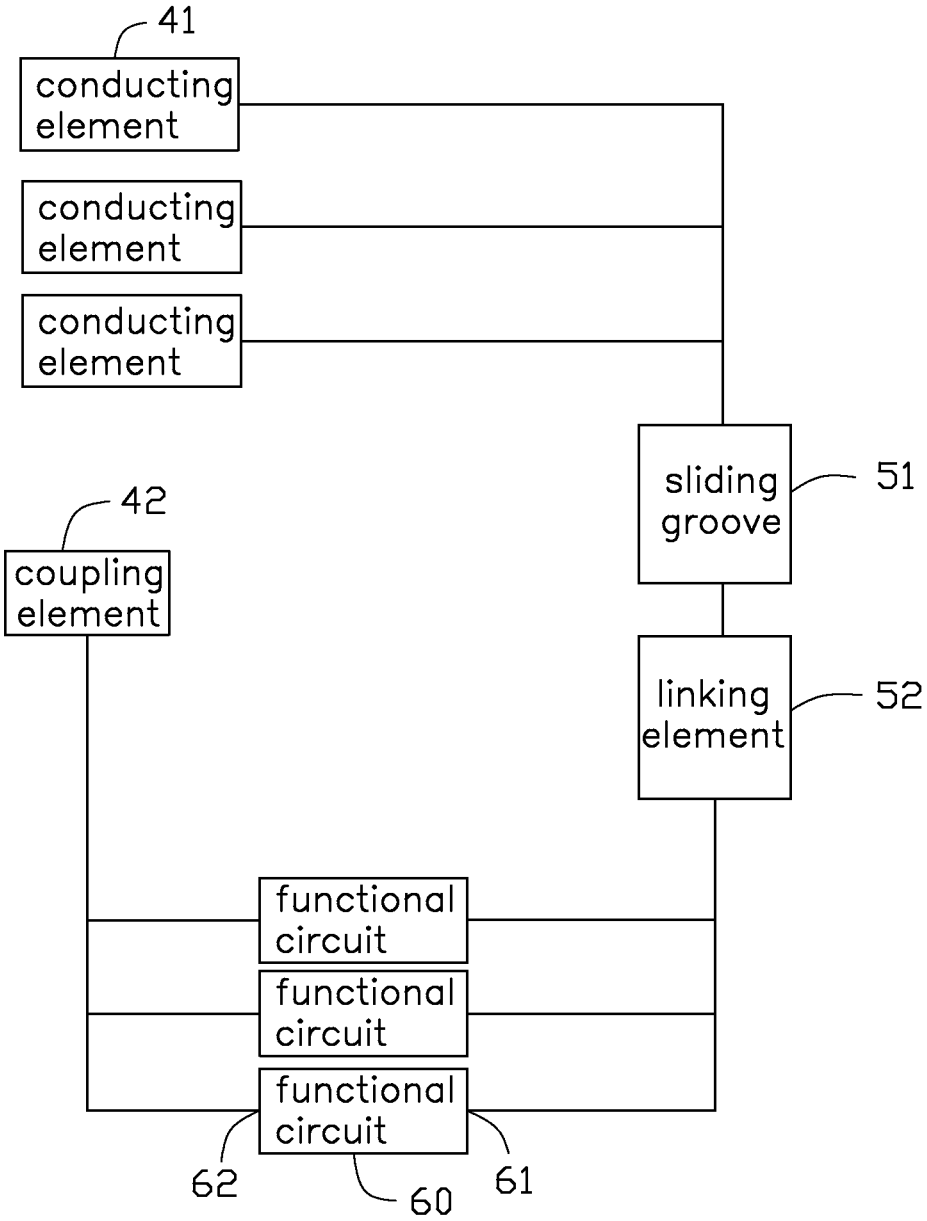
FIG. 15 is a block diagram of a sixth embodiment of the multi-use switch.

Referring to FIG. 15, in a sixth embodiment of the multi-use switch 101, one linking element 52 can be electrically coupled between the conducting elements 41 and the functional circuits 60 in parallel, and one coupling element 42 can be electrically coupled to the functional circuits 60 in parallel.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A multi-use switch comprising:

a pressing piece forming a plurality of conducting elements having at least one electrically conductive sliding groove in a circumferential periphery thereof;

a plurality of coupling elements, only one coupling element being electrically coupled with a corresponding one of the conducting elements at one time; and a linking element being in constant electrical coupling with the sliding groove;

wherein the pressing piece is movable along an axis thereof to make the linking element slide along the sliding groove and one of the coupling elements engage with a selected one of the conducting elements.

2. A multi-use switch for an electronic device, the switch comprising:

a pressing piece configured to be pressed by an external force;

a plurality of conducting elements located on the pressing piece and electrically coupled to a plurality of functional circuits of the electronic device in a one-to-one relationship; and at least one coupling element configured to be electrically coupled to the conducting elements;

wherein the multi-use switch is partially received inside a housing;

wherein the at least one coupling element is fixed to the housing;

wherein the pressing piece moves along an axis to move the plurality of conducting elements relative to the at least one coupling element;

wherein the at least one coupling element completes an electric circuit of one of the functional circuits when a corresponding conducting element is electrically coupled to the at least one coupling element; and one electric circuit of the functional circuits is able to be completed at any one time;

wherein: the pressing piece comprises a first columnar portion, a second columnar portion, and a limiting flange; the first columnar portion extends out of a hole defined in the housing; the plurality of conducting elements being located on the second columnar portion; and the limiting flange being positioned to resist against an inner surface of the housing surrounding the hole;

wherein: the at least one coupling element comprises a fixing portion and a coupling head; the fixing portion being fixed to the housing; the coupling head being slidably coupled to the second columnar portion of the pressing piece; the coupling head being axially aligned with the corresponding conducting element along the axis of the pressing piece; and the pressing piece being configured to move along the axis to electrically couple the coupling head to the corresponding conducting element;

wherein: the second columnar portion defines a plurality of grooves; the plurality of grooves being the same in number as the plurality of conducting elements; each conducting element being received in a corresponding groove; the coupling head being received in the corresponding groove when electrically coupled to the corresponding conducting element and the coupling head being configured to remain in the corresponding groove to remain electrically coupled to the corresponding conducting element when the external force is removed from the pressing piece.

3. The multi-use switch of claim 2, wherein a number of the at least one coupling element is one; and the coupling element is electrically coupled to one of the conducting elements at one time.

4. The multi-use switch of claim 3, wherein the coupling element is electrically coupled to the functional circuits in parallel.

5. The multi-use switch of claim 1, further comprising an elastic member that is compressed and restored along an axial direction of the pressing piece; and wherein the elastic member is coupled between the second columnar portion and the housing.

6. The multi-use switch of claim 5, wherein the elastic member is a compression spring; and the compression spring is sleeved on a mounting post protruding from the second columnar portion.

7. The multi-use switch of claim 2, wherein a number of the at least one coupling element corresponds in number to the conducting elements; and the coupling elements are electrically coupled to the conducting elements in a one-to-one relationship.

8. The multi-use switch of claim 7, wherein:

the conducting elements are located at different distances away from the limiting flange; and the conducting heads of the conducting elements are located at a same distance away from the limiting flange.

9. The multi-use switch of claim 7, wherein:

the conducting elements are located at a same distance away from the limiting flange; and the conducting heads of the conducting elements are located at different distances away from the limiting flange.

10. The multi-use switch of claim 2, wherein:

the multi-use switch further comprises at least one linking element;

the at least one linking element comprises a second fixing portion and a sliding head;

the second fixing portion is fixed to the housing;

the sliding head is slidably received in a sliding groove defined in the second columnar portion;

the sliding head slides in the sliding groove as the pressing piece moves along the axis;

the at least one linking element and the at least one coupling element cooperatively limit the pressing piece to move along the axis; and the functional circuits are each electrically coupled to the at least one linking element through a wall of the second columnar portion in the sliding groove.

11. The multi-use switch of claim 10, wherein:

the functional circuits are electrically coupled between the at least one coupling element and the at least one linking element; and the at least one linking element is electrically coupled between the conducting elements and the functional circuits.

12. The multi-use switch of claim 11, wherein a number of the at least one linking element, a number of the at least one coupling element, and a number of the conducting elements are the same; the linking elements are electrically coupled between the conducting elements and the functional circuits in a one-to-one relationship; and the functional circuits are electrically coupled between the coupling elements and the linking elements in a one-to-one relationship.

13. The multi-use switch of claim 11, wherein a number of the at least one coupling element is one, and a number of the at least one linking element is one; the coupling element and the linking element are electrically coupled to each of the functional circuits; and the functional circuits are electrically coupled between the coupling element and the linking element in parallel.

14. The multi-use switch of claim 11, wherein a number of the at least one linking element is one; a number of the at least one coupling elements is the same as a number of the conducting elements; the coupling elements are electrically coupled to the functional circuits in a one-to-one relationship; and the linking element is electrically coupled between each of the conducting elements and each of the functional circuits.

15. The multi-use switch of claim 14, wherein the linking element is coupled between the conducting elements and the functional circuits in parallel.

16. The multi-use switch of claim 11, wherein a number of the at least one coupling element is one; a number of the at least one linking element is the same as a number of the at least one conducting element; the linking elements are electrically coupled between the conducting elements and the functional circuits in a one-to-one relationship; and the coupling element is electrically coupled to each of the functional circuits.

17. The multi-use switch of claim 16, wherein the coupling element is electrically coupled to each of the functional circuits in a one-to-one relationship.

* * * * *